United States Patent [19]

Kates et al.

[11] Patent Number: 4,468,804

[45] Date of Patent: Aug. 28, 1984

[54] SPEECH ENHANCEMENT TECHNIQUES

[75] Inventors: James M. Kates, Andover; Julian J. Bussgang, Lexington, both of Mass.

[73] Assignee: Signatron, Inc., Lexington, Mass.

[21] Appl. No.: 352,958

[22] Filed: Feb. 26, 1982

[51] Int. Cl.[3] ..... G10L 1/00

[52] U.S. Cl. ..... 381/47

[58] Field of Search ..... 381/41–47; 364/513.5

[56] References Cited

U.S. PATENT DOCUMENTS

| | | | |
|---|---|---|---|
| 3,428,748 | 2/1969 | Flanagan | 179/1 SA |
| 3,760,108 | 9/1973 | Gacek et al. | 179/1 SA |
| 3,846,586 | 11/1974 | Griggs | 179/1 SA |
| 3,989,896 | 11/1976 | Reitboeck | 179/1 SA |
| 4,051,331 | 9/1977 | Strong et al. | 179/1 SA |
| 4,092,493 | 5/1978 | Rabiner et al. | 179/1 SA |
| 4,107,460 | 8/1978 | Grunza et al. | 179/1 SA |
| 4,123,711 | 10/1978 | Chow | 179/1 SC |
| 4,135,590 | 1/1979 | Gaulder | 179/1 SP |
| 4,156,868 | 5/1979 | Levinson | 340/146.3 WD |
| 4,164,626 | 8/1979 | Fette | 179/1 SC |
| 4,177,356 | 12/1979 | Jaeger et al. | 179/1 VL |
| 4,178,472 | 12/1979 | Funakubo et al. | 179/1 SD |
| 4,182,930 | 1/1980 | Blackmer | 179/1 R |
| 4,188,667 | 2/1980 | Graupe et al. | 364/724 |
| 4,207,543 | 6/1980 | Izakson et al. | 383/17 R |
| 4,227,046 | 10/1980 | Nakajima et al. | 179/1 SD |

OTHER PUBLICATIONS

Russell J. Niederjohn and James H. Grotelueschen, "The Enhancement of Speech Intelligibility in High Noise Levels by High-Pass Filtering Followed by Rapid Amplitude Compression", *IEEE Transactions on Acoustics, Speech, and Signal Processing,* vol. ASSP-24, No. 4, Aug. 1976, pp. 277–282.

Siegfried G. Knorr, "Reliable Voiced/Unvoiced Decision", *IEEE Transactions on Acoustics, Speech, and Signal Processing,* vol. ASSP-27, No. 3, Jun. 1979, pp. 263–267.

Harris Drucker, "Speech Processing in a High Ambient Noise Environment", *IEEE Transactions on Audio and Electroacoustics,* vol. AU-16, No. 2, Jun. 1968, pp. 165–168.

B. Gold and L. Rabiner, "Parallel Processing Techniques for Estimating Pitch Periods of Speech in the Time Domain", *J. Acoust. Soc. Am.,* vol. 46, No. 2 (Part 2), Aug. 1969, pp. 442–448 (reprinted on pp. 146–152).

Lawrence R. Rabiner, "On the Use of Autocorrelation Analysis for Pitch Detection", *IEEE Transactions on Acoustics, Speech, and Signal Processing,* vol. ASSP-25, Nov. 1, Feb. 1977, pp. 24–33.

John J. Dubnowski et al., "Real-Time Digital Hardware Pitch Detector", *IEEE Transactions on Acoustics, Speech, and Signal Processing,* vol. ASSP-24, No. 1, Feb. 1976, pp. 2–8.

Jae S. Lim et al., "Evaluation of an Adaptive Comb Filtering Method for Enhancing Speech Degraded by White Noise Addition", *IEEE Transactions on Acoustics, Speech, and Signal Processing,* vol. ASSP-26, No. 4, Aug. 1978, pp. 354–358.

Jae S. Lim and Alan V. Oppenheim, "Enhancement and Bandwidth Compression of Noisy Speech", *Proceedings of the Bandwidth Compression of Noisy Speech", Proceedings of the IEEE,* vol. 67, No. 12, Dec. 1979, pp. 1586–1604.

A. Risberg, "A Critical Review of Work on Speech Analyzing Hearing Aids", *IEEE Transactions on Audio and Electroacoustics,* vol. AU-17, No. 4, Dec. 1969, pp. 290–297.

Scott N. Reger, "Difference in Loudness Response of Normal and of Hard of Hearing Ears at Intensity Levels Slightly over Threshold, *Forty Germinal Papers in Human Hearing,* (no date), pp. 202–204.

M. Mazor et al., "Moderate Frequency Compression for the Moderately Hearing Impaired", *J. Acoust. Soc. Am.,* vol. 62, Nov. 1977, pp. 1273–1278 (reprinted as pp. 237–242).

Edgar Villchur, "Signal Processing to Improve Speech Intelligibility in Perceptive Deafness", *J. Acoust. Soc. Am.,* vol. 53, Jun. 1973, pp. 1646–1657 (reprinted as pp. 163–174).

Paul Yanick and Harris Drucker, "Signal Processing to Improve Intelligibility in the Presence of Noise for Persons with a Ski-Slope Hearing Impairment", *IEEE Transactions on Acoustics, Speech, and Signal Processing,* vol. ASSP-24, No. 6, Dec. 1976, pp. 507–512.

Ian B. Thomas and G. Barry Pfannebecker, "Effects of

Spectral Weighting of Speech in Hearing-Impaired Subjects", *Journal of the Audio Engineering Society,* vol. 22, No. 9, Nov. 1974, pp. 690–693.

*Primary Examiner*—E. S. Matt Kemeny
*Attorney, Agent, or Firm*—Robert F. O'Connell

[57] ABSTRACT

A method for processing a voiced speech waveform when the periods and amplitudes thereof may be non-uniform so that the intelligibility thereof is adversely affected. In accordance with such method successive portions of the speech waveform are processed so that each portion has a substantially uniform period and the intelligibility thereof is enhanced. In some instances the processing may be such as to provide in addition substantially uniform peak amplitudes in each processed portion. The voiced speech waveform enhancement technique may further be used in conjunction with methods for processing unvoiced speech waveforms so as to enhance the intelligibility thereof.

14 Claims, 5 Drawing Figures

SPEECH ENHANCEMENT TECHNIQUES

This application includes a microfiche appendix which comprises one microfiche having a total of 49 frames.

INTRODUCTION

This invention relates generally to speech intelligibility enhancement techniques and, more particularly, to techniques for the enhancement of the intelligibility voiced sounds in speech, either used alone or in conjunction with unvoiced speech enhancement techniques.

BACKGROUND OF THE INVENTION

U.S. patent application, Ser. No. 308,273, filed on Oct. 2, 1981, by J. Kates discusses the general problem of speech enhancement in systems wherein the speech has been electronically processed as, for example, in hearing aids, public address systems, radio and telephone communications systems, and the like. Such application primarily disclosed a unique and effective process for the enhancement of the intelligibility of unvoiced speech sounds, i.e., the consonant sounds therein. While such enhancement techniques provide an effective improvement in speech intelligibility, the processes disclosed therein are not particularly effective in connection with the enhancement of voiced (i.e., generally vowel) speech sounds. Accordingly, it is desirable to devise processes and systems for effectively improving the intelligibility of voiced sounds, which techniques can be utilized either alone or in conjunction with appropriate unvoiced sound enhancement processes such as are described in the aforesaid application.

BRIEF SUMMARY OF THE INVENTION

In accordance with the invention, voiced speech has a periodic characteristic and the intelligibility thereof is related to the uniformity of such periodic characteristic. Thus, voiced speech which tends to have lower intelligibility normally has a non-uniform periodicity, i.e., both the amplitudes and the spacing of the peaks thereof vary. In order to improve the intelligibility, the system of the invention processes the voiced speech so that it is provided with uniformly periodic charactertistics, which characteristics preferably represent a typical period or the combination of averaged period and amplitude thereof. Such processing, or "smoothing" technique improves the intelligibility of the voiced speech sounds.

In a specific embodiment, for example, a voiced portion of speech may be processed in suitable segments thereof, each processed segment having a uniform periodicity which represents the typical periodic characteristic of the actual speech segment. The processed segments can then be successively supplied to form the enhanced voiced speech portion. While the processing may be performed by an analog processing system, it appears preferable to digitize the speech segments and perform such processing by using digitized processing techniques.

DESCRIPTION OF THE INVENTION

The invention can be described in more detail with the help of the accompanying drawings wherein FIG. 1 depicts a block diagram of a system representing one embodiment of the invention;

Figure 2:
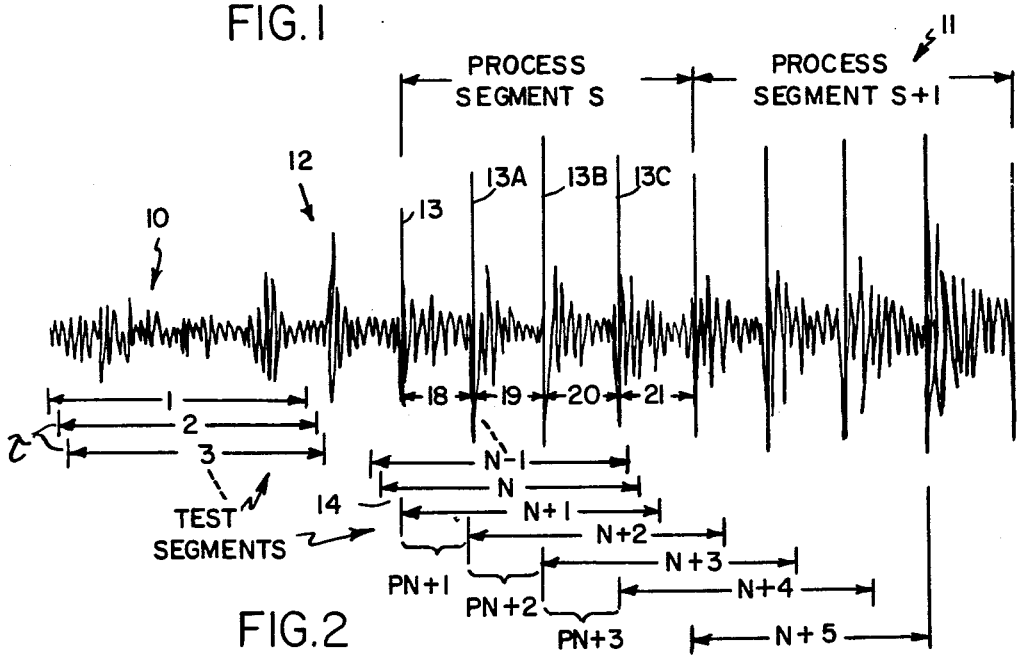
FIG. 2 represents a portion of a speech waveform having an unvoiced and a voiced portion for processing.
Figure 3:
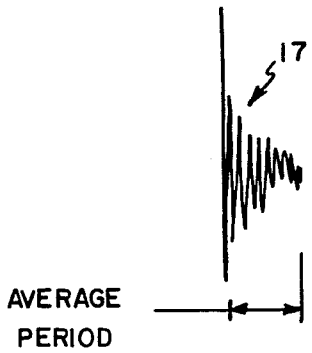
FIG. 3 represents a typical average period of a voiced speech waveform as produced in accordance with the invention.
Figure 4:
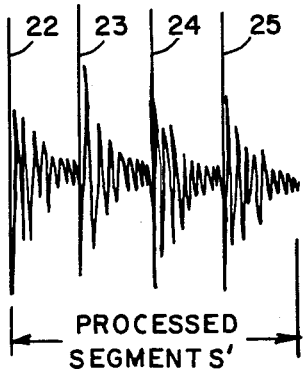
FIG. 4 represents a typical processed segment of a voiced speech waveform produced in accordance with the invention.

The operation of a system and method in accordance with the invention can be best understood by considering first the speech waveforms depicted in FIGS. 2, 3 and 4. FIG. 2 represents a portion of an exemplary speech waveform in which the initial portion 10 thereof represents unvoiced speech while the later portion 11 thereof represents voiced speech, a transition portion 12 generally occurring between the unvoiced and voiced portions. As can be seen therein, the unvoiced speech portion is essentially non-periodic and noise-like in character while the voiced portion generally has larger amplitude peaks and generally approaches a periodic nature.

In accordance with the technique of the invention, test segments each representing a selected portion of the speech signal are successively examined to determine whether such test segments are predominantly periodic or non-periodic in nature. The length of the test segments are appropriately selected and in an exemplary use of the technique of the invention, a test segment may be selected to have approximately 30 milliseconds (msec.) between its boundaries. The test segments are successively tested in relatively small time steps (i.e., of "$\tau$" msec.). That is, the time between the initial boundaries thereof, as shown by test segments 1, 2 and 3 . . . etc. in FIG. 2. In an exemplary use of the invention, the test segments may be examined successively in steps of approximately 1 to 10 msec. So long as a test segment is deemed to be non-periodic in nature, such segment is categorized as unvoiced speech and no vowel enhancement is provided by the invention, the speech being supplied as is for whatever purpose desired. In such case the examination of successive test segments continues in $\tau$ msec. steps and each $\tau$ msec. portion between initial boundaries is successively supplied as the output speech.

At some point during the testing process a transition from unvoiced to voiced speech occurs and an initial voiced test segment is indicated as being predominantly periodic in nature as opposed to the immediately preceding segment which was indicated as having a predominantly non-periodic characteristic. For example, the initial periodic test segment may be the test segment identified in FIG. 2 as segment N, where the previous test segment N−1 was indicated as non-periodic in nature.

Once the periodic character of a particular test segment has been identified, the subsequent successive test segments to be examined are suitably synchronized to an identified pitch period by synchronizing the next test segment so that its initial boundary is at a selected point in the pattern of the periodic waveform. For example, such point may be selected so that the initial boundary of the next test segment N+1 is at the nearest peak of the periodic waveform of test segment N. Thus, segment N+1 in FIG. 2 is arranged so that its initial boundary is at peak 13 and that portion 14 of the input speech signal between the initial boundary of segment N and the initial boundary of segment N+1 is supplied as an output from the system without any further processing. Once segment N+1 is so synchronized to the desired selected point in time, the subsequent test segments of the voiced speech waveform can be examined. Although the selected sychronization point shown in FIG. 2 is the peak 13, any other suitably selected point can be utilized, e.g., the first zero crossing prior to such peak.

Once the beginning of the voiced portion of the input speech signal has been identified and so synchronized, the voiced speech is processed in suitably selected process segments, the length of a process segment being appropriately selected to be an integral number M of the pitch periods. An exemplary length for a process segment may be one which includes four pitch periods, as shown by process segment S. Such process segment includes the four pitch periods which begin with peaks 13, 13A, 13B and 13C. Such pitch periods are approximately but not necessarily equal in duration. Such process segment and each successive process segment is appropriately processed in accordance with the invention, as described below, so long as the test segments retain their periodic character.

In testing each of the subsequent successive test segments, that is, segments N+2, N+3 and N+4, the segments are now stepped by an interval equal to the initial pitch period of the test segment waveform under current examination, e.g., the pitch period from peak 13 to peak 13A in segment N+1, the pitch period from peak 13A to 13B in segment N+2, etc. Thus, the examination of test segment N+1 permits a calculation of the initial pitch period, designated as period $P_{N+1}$, and the initial boundary of the next test segment N+2 is separated from the initial boundary of segment N+1 by such pitch period $P_{N+1}$. The initial pitch period $P_{N+2}$ is calculated for segment N+3 and segment N+3 then has an initial boundary which is separated from that of segment N+2 by such period. The initial pitch period $P_{N+3}$ is calculated for segment N+3 and the initial boundary of segment N+4 is separated from the initial boundary of segment N+3 by $P_{N+3}$. Finally, the initial pitch period $P_{N+4}$ is calculated for segment N+4.

Once the length of the process segment is selected, the average pitch period of the overall process segment is then determined by averaging the periods $P_{N+1}$, $P_{N+2}$, and $P_{N+4}$, such averaging process providing an average waveform duration of one pitch period. Other processing, such as using a weighted average, can also be used to determine a representative pitch period duration. The voiced speech in the process segment is then modified by replacing each of the individual pitch periods by a version thereof having a duration equal to the representative pitch period. The individual pitch period durations are adjusted by truncating the longer pitch periods and appending zeroes to one or both ends of the shorter pitch periods, by modifying the pitch period time base through expansion or contraction of the time base, either in a linear or a dynamic manner (a technique sometimes referred to in the speech recognition art as linear or dynamic "time warping"), or by other techniques that will occur to those in the art. The vowel intelligibility can be further enhanced, if desired, by averaging the speech waveforms in each of the adjusted pitch periods in the process segment. Such averaging process provides an average waveform of one period, the amplitude and period of which are the average of the four pitch periods shown in process segment S, for example. Such averaging process may produce the average waveform 17 as depicted in FIG. 3, which has an amplitude which is the average of the amplitudes of peaks 13, 13A, 13B and 13C and a period which is the average of the pitch periods 18, 19, 20 and 21 of the process segment S in FIG. 2.

Figure 5:
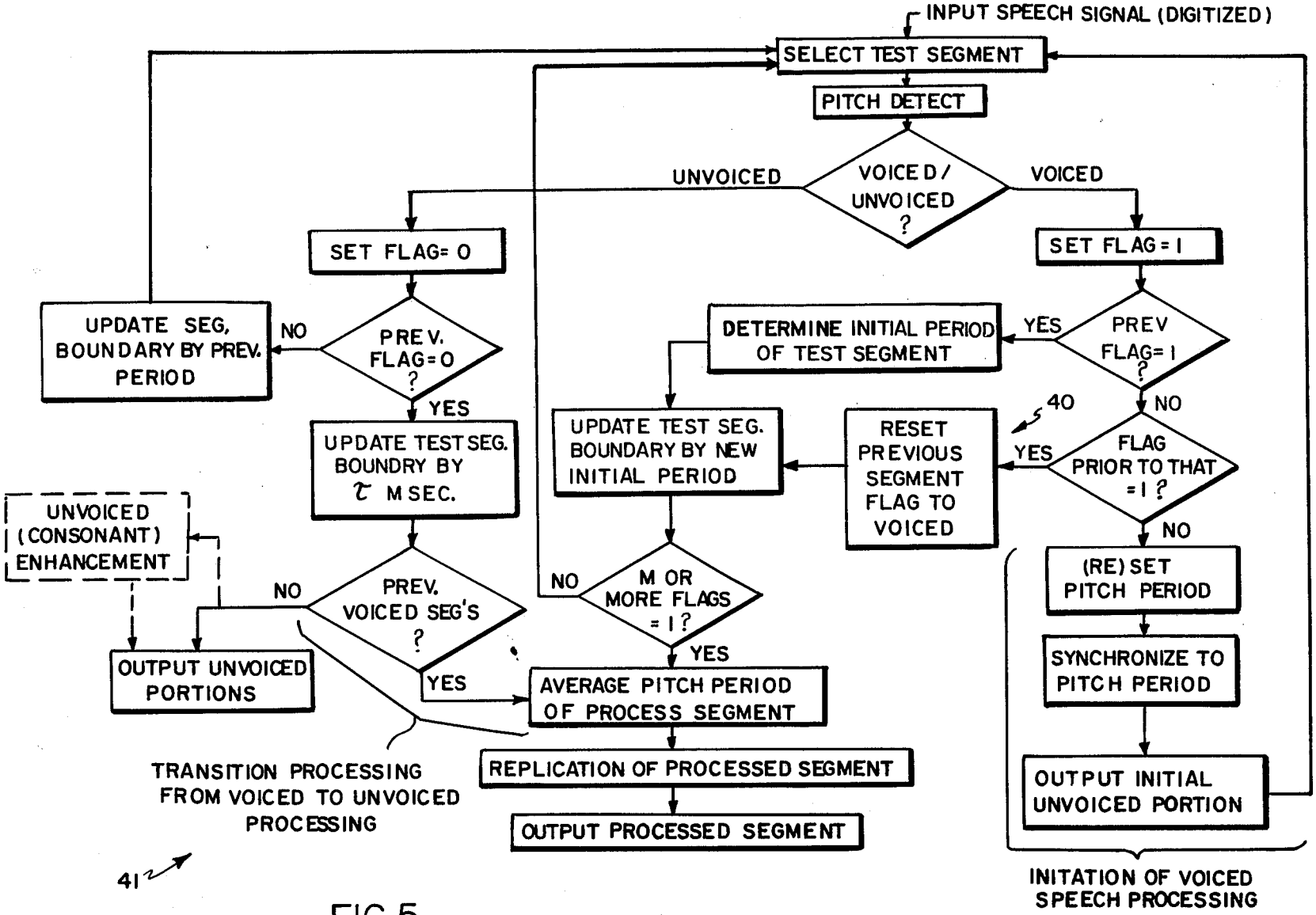
FIG. 5 depicts a flow chart showing one embodiment of a digital speech processing technique in accordance with the invention.

In accordance with the technique of the invention, such average waveform 17 may then be replicated four times, as shown in FIG. 5, to produce a processed segment S' which comprises four replications of average waveform 17, as depicted by peaks 22, 23, 24 and 25. The processed segment S' is then supplied as the desired portion of the output speech signal in place of process segment S of the actual speech signal. Once such processing has occurred the next process segment S+1 is then similarly tested and its average periodic waveform is determined, replicated and substituted in the same manner as occurs with reference to process segment S.

Accordingly, the voiced portion of the input speech signal, which voiced portion may have varying pitch periods and varying amplitudes, is effectively smooth in accordance with the technique of the invention and the intelligibility of such input speech signal portion is enhanced. The smoothing, as described above, can be removing the pitch period duration fluctuations or can be replacing the waveform with an averaged version that provides amplitude smoothing as well.

Figure 1:
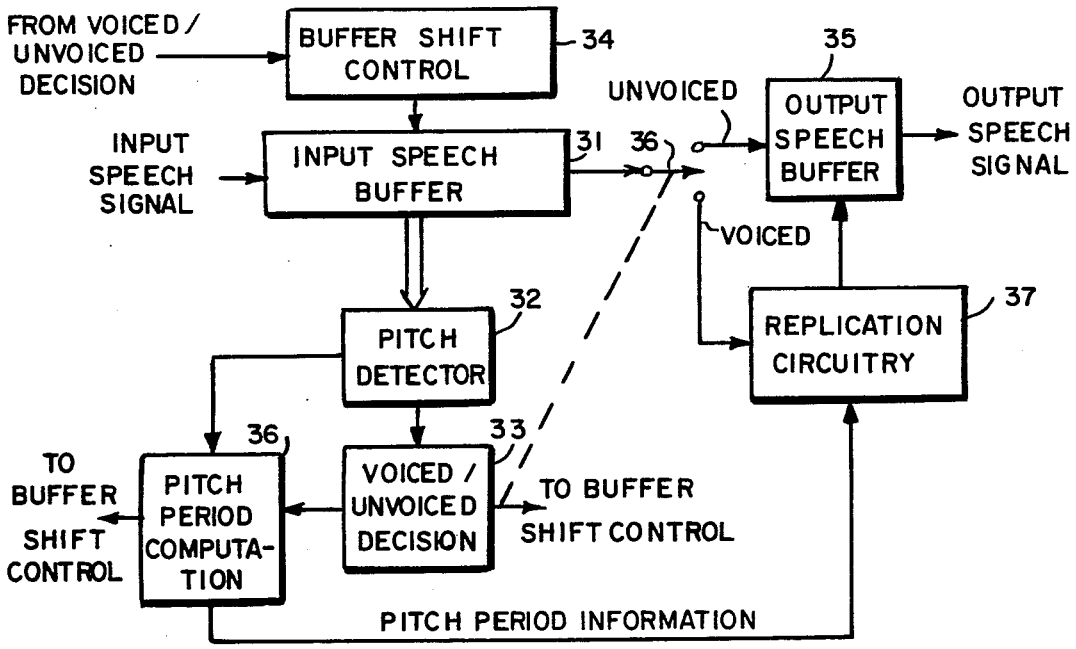

The block diagram depicted in FIG. 1 shows in an analog manner a system for performing both the pitch and amplitude processing operations discussed above with reference to FIGS. 2, 3 and 4. Thus, an input speech signal 30 is supplied to an input speech buffer unit 31 which stores a selected portion of the input speech signal and is capable of supplying to a pitch detector unit 32 a test segment of such stored signal having a selected length, i.e., 30 msec. The test segment is supplied to pitch detector 32 for appropriate examination to determine it periodic or non-periodic character so that the voiced or unvoiced nature of the segment can be determined. If the pitch detector determines that the current test segment under examination is essentially non-periodic in nature (i.e., unvoiced in its character) an appropriate decision is made by voiced/unvoiced decision circuitry 33. The result of such decision is that an appropriate shift control signal is supplied to buffer control circuitry 34 to shift the test segment of the input speech signal stored therein by a relatively small amount, e.g., $\tau$ msec., as discussed above, which shift is used when examining unvoiced test segments. During such shift the small portion of the input speech representing such shift is thereby shifted out of the input speech buffer to an output speech buffer 35 via appropriate switching techniques as shown diagrammatically by switch 36 so that such small speech portion then becomes available as the output speech signal.

Thus, as each test segment is shifted by $\tau$ msec., a portion having a time length equal to $\tau$ msec. is shifted out of the input speech buffer, so long as the pitch detector 32 indicates that the test segment under examination is of a nonperiodic, or unvoiced, nature. When, during the course of the transition from unvoiced to voiced speech, a test segment is first indicated as being periodic in nature, e.g., as in segment N of FIG. 2, the pitch detector provides an appropriate indication to voiced/unvoiced decision circuitry 33 so as to prevent any further supplying of the input speech from the input speech buffer to the output speech buffer until a desired process segment thereof has been suitably processed. Accordingly, the voiced/unvoiced decision circuit 33 effectively switches the output of input speech buffer 31 from the "unvoiced" position to the "voiced" position for providing the processing described below.

Decision circuitry 33 then produces the necessary shift control signal which permits the next test segment (e.g., test segment N+1) to be synchronizied so as to begin at the desired selected point in the voiced input speech waveform (e.g., the initial peak 13 of process segment S, for example, or the first zero crossing prior to peak 13, or some other appropriate point as desired). A pitch period computation circuit 36 then computes the initial period of segment N+1 (e.g., $P_{N+1}$ in FIG. 2) which then determines the next shift control signal to buffer shift control circuit 34 so that the initial boundary of the next test segment (e.g., segment N+2 in FIG. 2) to be examined begins after a shift of $P_{N+1}$. The process of examining successive test segments N+3 to N+4 continues until, in the particular embodiment being discussed, four consecutive segments (N+1 through N+4) have been examined and have been indicated as periodic in nature. The number of such test segments depends on the length of the processed segment which is desired and can be set to any appropriate number in any particular application in which the system is being used. Four periods appears to be a practical number for processing and, accordingly, the exemplary embodiment discussed herein is based thereon.

Once it has been determined that an initial overall process segment S is periodic in nature, the pitch period computation circuitry 36 then indicates a pitch period duration which represents the typical period duration in such process segment. The representative period duration can then be used to produce a portion of speech which represents the typical period in such processs segment. The average waveform in this example, which is so computed, represents a speech portion having an amplitude which is the average of the amplitudes of each of the peaks in the process segment and a period which represents the average of each of the periods therein. Such average waveform is shown in FIG. 3. The average pitch period and the boundaries of the process segment S, as determined by the pitch period computation circuit 36, are supplied to waveform replication circuitry 37 so that the process segment S is then re-formed so as to provide a processed segment S' which represents a selected number of replications of the average period of FIG. 3. Such re-formed processed segment S' is shown in FIG. 4. The re-formed waveform is supplied to the output speech buffer unit 35 and is, in effect, substituted for the corresponding portion of the input speech signal (process segment S) and represents an averaged or smoothed representation thereof. As mentioned above, other averaging procedures along or in combination with dynamic time warping can also be used while remaining within the scopie of this invention.

The system then continues to examine the next process segment S+1 of the input speech signal in the same manner. The latter segment is then again averaged and the average period thereof is then replicated and the replicated, or smoothed, version of process segment S+1 is then supplied to output speech buffer 35 as processed segment (S+1)' following the previously processed segment S'. In such manner the overall voiced portion of the input speech signal is thereby enhanced and its intelligibility improved.

While it would be possible for those in the art to provide analog circuitry for implementing the block diagram shown in FIG. 1, it appears to be more effective to provide for processing of the input signal in digitized form and to use a suitable digital processing system (e.g., a computer or special-purpose digital hardware). Said digital processing system can be used to effect pitch period smoothing, pitch period averaging, or a combination of waveform time-base adjustment and amplitude averaging in the manner shown in FIG. 5. The latter figure depicts a flow chart for performing the necessary processing steps in a suitable digital computer which can be duly programmed in accordance with such flow chart. In FIG. 5, the input speech signal in digitized form (the digitization of a speech signal can be performed in accordance with well-known techniques in the art) is supplied to the processor which selects the boundaries of a suitable test segment, as shown in FIG. 2, and supplies such test segments consecutively, as discussed above, to pitch detector circuitry to determine whether the particular segment under examiner is generally periodic or non-periodic in nature.

In general, pitch detection techniques for detecting the periodic or non-periodic nature of digitized speech have been utilized in the art. For example, a particular technique has been suggested in the article "Parallel Processing Techniques for Estimating Pitch Periods of Speech in the Time Domain", by B. Gold and L. Rabiner, Jour. Acoust. Soc. Am., Vol. 46, August 1969, pages 442–448 and in the article "On the Use of Autocorrelation Analysis for Pitch Detection", by L. Rabiner, IEEE Trans. Acoust. Speech and Sig. Proc., Vol. ASSP-25, No. 1, February 1977, pages 24–33. Such techniques determine the general periodicity of an input speech signal. Once such periodicity is determined, the speech signal can be characterized as voiced in nature. Other techniques for determining the voiced or unvoiced character of a speech signal can also be utilized and are known to the art.

Once a test segment has been appropriately detected, as shown in the flow chart of FIG. 5, the detection process permits a decision as to the voiced or unvoiced nature thereof to be made. If the particular test segment having the selected boundaries is determined to be unvoiced, a suitable flag bit is appropriately set to a particular state. In the particular flow chart depicted in FIG. 5 the flag is set to "0" if the test segment is unvoiced and is set to "1" if the test segment is voiced. In the case where the current test segment is unvoiced and the flag is set to "0" the status of the previous flag is then examined to determine whether it was also set to "0". If the previous flag was a "0" (indicating that the previous test segment was also unvoiced in character), the boundaries of next test segment to be examined are updated by $\tau$ msec. so that the next segment (e.g., segment 2) can be examined. So long as the current flag and the previous flag have both been set to "0" and there are no previous voiced segments which have been processed, the output speech signal between the initial boundaries of segments 1 and 2 (equal to $\tau$ msec. in length) is provided as an output speech signal from the system. If there are previous voiced segments, such condition represents a transition from voiced to unvoiced speech and such transition can be taken care of as discussed later below.

When the pitch detection process indicates that the particular test segment under examination is voiced in character (e.g., segment N in FIG. 2), the flag bit is set to "1". The previous flag is also examined and, if the current test segment is the first test segment of a voiced speech portion, the previous flag bit will not be a "1" and it will be necessary to initiate the voiced processing technique previously described above.

Before such initiation process, not only is the previous flag bit examined but also the flag bit prior thereto. If the two previous flags both indicate that the two previous test segments are unvoiced (flag bit=0) the initiation of the voiced speech processing then occurs. In accordance therewith the pitch period of the first voiced segment (segment N) is then determined (identified, for example, as $P_N$ in FIG. 2) and the first segment is synchronized to an appropriate point in the speech waveform such as the initial peak of the segment, or the initial zero crossing prior to such first peak. When the synchronization occurs, the unvoiced portion of the speech signal between the initial boundaries of segment N the next test segment N+1 is then supplied as an output speech signal to the system. The boundaries for the next test segment (segment N+1) having been so determined by the synchronization process, the pitch detection process is then performed for segment N+1. The flag bit at this particular stage need not be reset to a "1" state since the current test segment N+1 merely represents the previous test segment N shifted by the amount necessary to provide for the desired synchronization. The initoal period of the current test segment N+1 is then determined and the next test segment N+2 is selected by updating the initial boundary thereof from segment N+1 by an amount equal to the initial period of segment N+1.

Segment N+2 is then examined by the pitch detection process and if such segment (as in the example of FIG. 2) is periodic in nature the flag is again set to "1" and the initial test segment period for segment N+2 is then determined. The next segment to be tested is then updated by such initial test segment period to permit segment N+3 to be examined. Such process continues until a selected number M of successive segments have been determined as periodic in nature, in which case the boundaries of a process segment are then determined. For example, in FIG. 2, process segment S is determined to have boundaries represented by the initial boundary of initially synchronized segment N+1 and the initial boundary of segment N+5. The process segment S, in effect, therefore, includes four (M=4) periodic portions of voiced speech.

Once the boundaries of process segment S are known, the average pitch period of the process segment can then be determined, such averaging process providing one period of the speech signal which has an amplitude which is the average of the amplitudes of the peaks of the four periodic portions of the process segment S and a period equal to an average of such four periodic portions. Such an average speech waveform period may be represented, for example, by the exemplary voiced speech waveform shown in FIG. 3. Such average period is then replicated the desired number of times (in this case M=4) so as to reproduce the process segment in its averaged form, as shown by process segment S' in FIG. 4. The processed segment S' is then supplied as the next portion of the output speech waveform (following unvoiced portion 14) as indicated in FIG. 5.

Such processing continues so long as each process segment has the desired periodic nature. Accordingly, each successive process segment is averaged, replicated and supplied as the output speech waveform for such process segment time period until the voiced speech signal becomes unvoiced in character.

Two conditions may exist which require a departure from the above processing technique, as shown in FIG. 5. If for some reason a test segment appears unvoiced in character but such unvoiced test segment incorrectly occurs within a voiced speech portion, such anomaly should be effectively ignored by the processing system. Such case is taken care of if, during the testing of a specific voiced segment, it is determined that the previous test segment was unvoiced character (the previous flag bit was a "0"). The next prior flag is then tested and if such test indicates that the next prior segment was voiced (flag=1), the flag for the unvoiced previous segment is reset to a "1" and the current test segment is updated by the previously determined period, as shown by the flow chart path 40 in FIG. 5. Accordingly, the presence of a single unvoiced test segment preceded and followed by voiced test segments is effectively ignored and treated as a voiced segment for purposes of processing, the unvoiced indication being effectively treated as an error in the processing.

If, however, a voiced test segment is followed by two unvoiced segments, the processing, as shown in FIG. 5, treats such condition as the beginning of a transition stage from voiced to unvoiced speech. Such operation is shown by the flow chart path 41 at the left-hand side of the flow chart of FIG. 5 wherein the current test segment sets the flag to "0" because of its unvoiced character, the previous test segment has already been set to "0" and the system updates to the next test segment by the smaller step ($\tau$ msec.). If there is a true transition then the test segments previous thereto are voiced and during such transition region the average pitch period of the periodic portion thereof is then determined and an appropriate process segment having such average pitch period is replicated until there are no previous voice segments in which the case the output unvoiced portions are then provided in the same manner as such output unvoiced portions were provided prior to the transition from unvoiced to voiced speech.

Accordingly, the flow chart of FIG. 5 understood in connection with the speech waveform patterns shown in FIGS. 2, 3 and 4 describes a specific technique of the invention for processing voiced speech in order to improve its intelligibility. In summary, each process segment of the voiced speech (as selectively determined by the number of consecutive voiced test segments encountered) is averaged and the average period thereof is replicated a selected number of times to produce a processed output segment which is supplied as a substitute for the original voiced speech process segment. The output processed segments each have uniform periods and amplitudes determined by the average period of the unprocessed speech segment from which they are derived. Such technique improves the intelligibility of the voiced speech for use in whatever overall system application the technique may be employed. Thus, the enhanced speech may be supplied for use in telephone systems, radio systems, loudspeaker systems, etc. If the input speech in such system has a reduced quality of intelligibility of its voiced portions, such voiced portions are thereby enhanced to improve their intelligibility.

The implementation of the flow chart of FIG. 5 can be readily performed utilizing known digital processors (e.g. a computer or special purpose digital hardware system) for performing each of the steps involved. Such implementation would be within the skill of the art since the processors would merely have to be appropriately programmed to implement each of the flow chart operations. An exemplary program listing is included herein in microfiche form as an appendix hereto, as mentioned above, such microfiche appendix being incorporated herein as by reference, under the provisions of 37 CFR 1.96, as an exemplary program for use in implementing the flow chart of FIG. 5. Other programs for implementing such flow chart may occur to those in the art for performing substantially the same operations. Moreover, it may be desirable in some applications to perform the voiced speech enhancement process in an analog manner rather than in the digitized manner shown by the flow chart of FIG. 5, generally following the block diagram depicted in FIG. 1. Each of the functions of the blocks shown therein can also be implemented by suitable analog circuitry within the skill of the art, as desired.

While the system described above deals with the enhancement of voiced speech sounds such system, as previously mentioned, can be used in conjunction with techniques for enhancing unvoiced speech sounds. As can be seen in FIG. 5, when an input speech waveform segment has been determined to be unvoiced in character, the unvoiced portions were supplied directly in unchanged form as the output speech waveform therefrom. However, before supplying unvoiced speech to whatever user system is involved (e.g. a hearing aid, a voice communication transmitter or receiver, etc.) such unvoiced speech portions can be subjected to an enhancement process designed primarily for dealing with unvoiced or consonant sounds, as depicted by the dashed line path at the lower left of FIG. 5. The unvoiced speech output portions are thus supplied to a suitable consonant (unvoiced) speech enhancement process and thence supplied as the desired output unvoiced speech portions. Any appropriate consonant enhancement process known to the art may be used. For example, one effective process for such purpose which is known at this time is disclosed in copending United States patent application, Ser. No. 308,273, filed Oct. 2, 1981, by J. Kates in which consonant enhancement is achieved by equalizing the intensity of such sounds to that of vowel (unvoiced sounds). For example, a short-time estimate of the relative spectral shape of an input unvoiced speech signal is determined and control means are provided in response thereto for dynamically controlling a modification of the spectral shape of the actual speech signal so as to produce a modified, and enhanced, unvoiced output speech signal. Specific techniques are described in the aforesaid patent application and, in order to avoid undue complexity in the description herein, the contents of such application are incorporated herein by reference. The use of the particular voiced speech enhancement processs disclosed herein, together with such unvoiced speech enhancement process can be provided in a system for the enhancement of overall speech waveforms, both voiced and unvoiced, in order to produce considerable improvement in the intelligibility thereof in whatever application is desired. Such applications may include hearing aids, public address systems, radio transmission, or pre-processing prior to the digital encoding of the speech signal. Accordingly, the above referred to microfiche appendix also includes program techniques for enhancing consonant (unvoiced) speech in accordance with the techniques disclosed in the above-referenced Kates application. Such program also includes a subroutine for combining clear speech with Gaussian noise for testing purposes.

While the disclosure contained herein discusses particular embodiments of the invention, modifications thereof may occur to those in the art within the spirit and scope of the invention. Hence, the invention is not deemed necessary to be limited to the particular embodiments therein, except as defined by the appended claims.

What is claimed is:

1. A method of processing a voiced speech waveform which is generally periodic, the periods and peak amplitudes of which may be non-uniform, said method comprising the steps of processing said speech waveform so as to provide successive processed portions thereof, each portion having a substantially uniform period; and supplying said processed portions successively to provide an output speech waveform which is an effective reproduction of said input speech waveform, wherein the pitch fluctuations of the voiced sounds have been smoothed.

2. A method of processing an input speech waveform having voiced sounds comprising the steps of processing successive portions of said voiced speech waveform by determining a representative period in each said portion; and forming successive processed portions from said successive portions each of which contains a periodic waveform having a substantially uniform period equal to the corresponding determined representative period and a substantially uniform peak amplitude, said successive processed portions thereby providing an output speech waveform, wherein the pitch and amplitude fluctuations of the voiced sounds have been smoothed.

3. A method of processing voices sounds in an input speech waveform comprising the steps of (a) detecting the periodic or non-periodic nature of successive segments of said input speech waveform to determine whether a currently detected segment of said speech waveform comprises voiced or unvoiced sounds;

(b) detecting a selected sample period of each of said selected number of successive segments of said input speech waveform when said selected number of successive segments are all detected as comprising periodic voiced sounds; and (c) adjusting the duration of each pitch period within said selected number of successive segments to be equal to said selected sample period.

4. A method of processing voiced sounds in an input speech waveform comprising the steps of (a) detecting the periodic or non-periodic nature of successive segments of said input speech waveform to determine whether a currently detected segment of said speech waveform comprises voiced or unvoiced speech sounds;

(b) determining a selected sample period of each of said selected number of successive segments of said input speech waveform when said selected number of successive segments are all detected as comprising periodic voiced sounds;

(c) forming a representative period of voiced sounds; and (d) producing a plurality of successive ones of said representative period equal to said selected number to provide a processed output speech portion, wherein the pitch and amplitude fluctuations of the voiced sounds have been smoothed.

5. A method of processsing voiced sounds in an input speech waveform according to claim 4 and further including the steps of repeating steps (a), (b), (c) and (d) to provide a plurality of successive processed output speech portions representing an output speech waveform which is a processed form of said input speech waveform wherein the pitch and amplitude fluctuations of the voiced sounds have been smoothed.

6. A method in accordance with claims 4 or 5 wherein said selected sample period is the initial period of each said segment.

7. A method in accordance with claim 6 wherein the initial boundary of each segment is separated from the initial boundary of the preceding segment by said initial period, the speech waveform between the initial boundary of the first of said selected number of successive segments and the initial boundary of the last of said selected number of successive segments forming the portion of said input speech waveform to be processed.

8. A method in accordance with claim 6 wherein the initial boundary of the first of said selected number of successive segments is synchronized to a selected point in said segment.

9. A method in accordance with claim 8 wherein said selected point is the initial peak amplitude in said first segment.

10. A method in accordance with claim 8 wherein said selected point is the first zero crossing prior to the initial peak amplitude in said first segment.

11. A method in accordance with claim 5 wherein the length of said segments is selected to be sufficiently long so as to include more than one voiced speech period when said segment contains voiced speech.

12. A method in accordance with claim 11 wherein the length of said segments is selected to be about 30 milliseconds.

13. A method in accordance with claim 5 wherein the time between the initial boundaries of successive segments which contain primarily unvoiced speech is selected to be smaller than the time between the initial boundaries of successive segments which contain primarily voiced speech.

14. A method in accordance with claim 13 wherein the time between the initial boundaries of successive segments which contain primarily unvoiced speech is selected to be about 1 to 10 milliseconds.

* * * * *